US007507130B2

(12) United States Patent
Watanabe et al.

(10) Patent No.: US 7,507,130 B2
(45) Date of Patent: Mar. 24, 2009

(54) REMOTE CONTROL DEVICE FOR A BOAT

(75) Inventors: Eifu Watanabe, Hamamatsu (JP); Noriyoshi Ichikawa, Hamamatsu (JP); Isao Kanno, Hamamatsu (JP)

(73) Assignee: Yamaha Marine Kabushiki Kaisha (JP)

( * ) Notice: Subject to any disclaimer, the term of this patent is extended or adjusted under 35 U.S.C. 154(b) by 0 days.

(21) Appl. No.: 11/731,086

(22) Filed: Mar. 30, 2007

(65) Prior Publication Data

US 2008/0003898 A1 Jan. 3, 2008

(30) Foreign Application Priority Data

Jul. 3, 2006 (JP) ..... 2006-183581

(51) Int. Cl.
*B60W 10/04* (2006.01)

(52) U.S. Cl. ..... 440/84

(58) Field of Classification Search ..... 440/84
See application file for complete search history.

(56) References Cited

U.S. PATENT DOCUMENTS

| | | | | |
|---|---|---|---|---|
| 1,843,272 | A | 2/1932 | Evinrude | |
| 2,204,265 | A | 6/1940 | Wentzel | |
| 2,466,282 | A | 4/1949 | Sparrow et al. | |
| 2,740,260 | A | 4/1956 | Blanchard | |
| 3,986,363 | A | 10/1976 | Beamon et al. | |
| 4,412,422 | A | 11/1983 | Rossi | |
| 4,622,938 | A | 11/1986 | Wenstadt et al. | |
| 4,646,696 | A | 3/1987 | Dogadko | |
| 4,648,697 | A | 3/1987 | Kawazoe | |
| 4,747,381 | A | 5/1988 | Baltz et al. | |
| 4,755,156 | A | 7/1988 | Wagner | |
| 4,788,955 | A | 12/1988 | Wood | |
| 4,801,282 | A * | 1/1989 | Ogawa et al. | 440/84 |
| 4,805,396 | A | 2/1989 | Veerhusen et al. | |

(Continued)

FOREIGN PATENT DOCUMENTS

| | | |
|---|---|---|
| JP | 03-061196 | 3/1991 |

(Continued)

OTHER PUBLICATIONS

U.S. Appl. No. 11/728,819, filed Mar. 27, 2007, entitled Boat Having Prioritized Controls.

(Continued)

*Primary Examiner*—Stephen Avila
(74) *Attorney, Agent, or Firm*—Knobbe, Martens, Olson & Bear, LLP

(57) ABSTRACT

A remote control device for controlling a propulsion unit of a boat is provided. The remote control device comprises a main body having a shift lever. A housing board is coupled to the main body of the remote control device and extends in a downward direction. The housing board houses a remote control engine control unit that provides an operation output signal to the propulsion unit based on an operation input signal received from the shift lever. In one embodiment, an operator can access the remote control engine control unit from either a starboard side or a port side of the boat. The remote control device can include an additional housing board that is capable of being attached to and detached from the housing board that is coupled to the main body.

25 Claims, 5 Drawing Sheets

U.S. PATENT DOCUMENTS

| | | | | |
|---|---|---|---|---|
| 4,809,506 | A | 3/1989 | Lauritsen | |
| 4,810,216 | A * | 3/1989 | Kawamura | 440/2 |
| 4,836,809 | A | 6/1989 | Pelligrino | |
| 4,850,906 | A | 7/1989 | Kanno et al. | |
| 4,858,585 | A | 8/1989 | Remmers | |
| 4,898,045 | A | 2/1990 | Baba | |
| 4,964,276 | A | 10/1990 | Sturdy | |
| 5,004,962 | A | 4/1991 | Tonss et al. | |
| 5,051,102 | A | 9/1991 | Onoue | |
| 5,062,403 | A | 11/1991 | Brechenfeld et al. | |
| 5,062,516 | A | 11/1991 | Prince | |
| 5,065,723 | A | 11/1991 | Broughton et al. | |
| 5,103,946 | A | 4/1992 | Masters et al. | |
| 5,157,956 | A | 10/1992 | Isaii et al. | |
| 5,167,212 | A | 12/1992 | Peter et al. | |
| 5,273,016 | A | 12/1993 | Gillespie et al. | |
| 5,318,466 | A | 6/1994 | Nagafusa | |
| 5,381,769 | A | 1/1995 | Nishigaki et al. | |
| 5,492,493 | A | 2/1996 | Ohkita | |
| 5,539,294 | A | 7/1996 | Kobayashi | |
| 5,595,159 | A | 1/1997 | Huber et al. | |
| 5,664,542 | A | 9/1997 | Kanazawa et al. | |
| 5,730,105 | A | 3/1998 | McGinnity | |
| 5,749,343 | A | 5/1998 | Nichols et al. | |
| 5,771,860 | A | 6/1998 | Bernardi | |
| 5,782,659 | A | 7/1998 | Motose | |
| 5,899,191 | A | 5/1999 | Rabbit et al. | |
| 6,015,319 | A | 1/2000 | Tanaka | |
| 6,026,783 | A | 2/2000 | Nestvall et al. | |
| 6,058,349 | A | 5/2000 | Kikori et al. | |
| 6,073,509 | A | 6/2000 | Salecker et al. | |
| 6,073,592 | A | 6/2000 | Brown et al. | |
| 6,095,488 | A | 8/2000 | Semeyn, Jr. et al. | |
| 6,098,591 | A | 8/2000 | Iwata | |
| 6,109,986 | A | 8/2000 | Gaynor et al. | |
| 6,233,943 | B1 | 5/2001 | Beacom et al. | |
| 6,273,771 | B1 | 8/2001 | Buckley et al. | |
| 6,280,269 | B1 | 8/2001 | Gaynor | |
| 6,351,704 | B1 | 2/2002 | Koerner | |
| 6,379,114 | B1 | 4/2002 | Schott et al. | |
| 6,382,122 | B1 | 5/2002 | Gaynor et al. | |
| 6,414,607 | B1 | 7/2002 | Gonring et al. | |
| 6,485,340 | B1 * | 11/2002 | Kolb et al. | 440/84 |
| 6,587,765 | B1 | 7/2003 | Graham et al. | |
| 6,612,882 | B2 | 9/2003 | Shidara et al. | |
| 6,704,643 | B1 | 3/2004 | Suhre et al. | |
| 6,751,533 | B2 | 6/2004 | Graham et al. | |
| 6,910,927 | B2 | 6/2005 | Kanno | |
| 6,965,817 | B2 | 11/2005 | Graham et al. | |
| 7,121,908 | B2 | 10/2006 | Okuyama | |
| 7,142,955 | B1 | 11/2006 | Kern et al. | |
| 7,153,174 | B2 | 12/2006 | Takeda et al. | |
| 7,220,153 | B2 | 5/2007 | Okuyama | |
| 2003/0082962 | A1 | 5/2003 | Kanno | |
| 2003/0093196 | A1 | 5/2003 | Okuyama | |
| 2004/0029461 | A1 | 2/2004 | Shomura | |
| 2005/0118895 | A1 | 6/2005 | Kanno et al. | |
| 2005/0245145 | A1 | 11/2005 | Takada et al. | |
| 2005/0286539 | A1 | 12/2005 | Okuyama | |
| 2006/0240720 | A1 | 10/2006 | Yamashita | |
| 2007/0082565 | A1 | 4/2007 | Okuyama | |
| 2007/0082566 | A1 | 4/2007 | Okuyama | |
| 2007/0178780 | A1 | 8/2007 | Ito et al. | |
| 2007/0218785 | A1 | 9/2007 | Okuyama | |
| 2007/0232162 | A1 | 10/2007 | Okuyama et al. | |
| 2007/0293102 | A1 | 12/2007 | Okuyama et al. | |

FOREIGN PATENT DOCUMENTS

| | | |
|---|---|---|
| JP | 2001-260986 | 9/2001 |
| JP | 2003-098044 | 4/2003 |
| JP | 2003-300903 | 10/2003 |
| JP | 2004-068704 | 3/2004 |
| JP | 2004-344803 | 12/2004 |
| JP | 2005-297785 | 10/2005 |
| JP | 2006-066450 | 3/2006 |
| WO | WO 2005-102833 | 11/2005 |

OTHER PUBLICATIONS

U.S. Appl. No. 11/731,681, filed Mar. 30, 2007, entitled Remote Control Apparatus for a Boat.

U.S. Appl. No. 11/731,691, filed Mar. 30, 2007, entitled Remote Control System for a Watercraft.

U.S. Appl. No. 11/731,057, filed Mar. 30, 2007, entitled Remote Control Unit for a Boat.

U.S. Appl. No. 11/731,422, filed Mar. 30, 2007, entitled Remote Control System for a Boat.

Product Manual for i6000TEC—Triple Engine Electronic Shift & Throttle of Teleflex Marine Co., Ltd., Jul. 2000.

Barron, Jim, "Get on the Bus," Trailer Boats Magazine, Jun. 2000, p. 36.

Spisak, Larry, "Know It by Chart," Boating Magazine, May 2000, p. 100.

Denn, James, "Gains in technology will alter makeup of the . . . ," Boating Industry International, Nov. 2000, pp. 41-47.

Declaration of Daniel J. Carr, submitted in U.S. Appl. No. 09/874,545, dated May 15, 2002.

Denn, James, "Future boats sales will hinge on technology," Boating Industry International, Nov. 2000, p. 40.

Hemmel, Jeff, "Information, Please—The digital boating revolution begins," Boating Magazine, Sep. 2000.

Kelly, Chris, "Can We Talk?" Power & Motoryacht Magazine, Jun. 2000, pp. 36, 38 and 39.

"Plug and Play", Advertisement from "Motorboating," Dec. 2000, p. 57.

Instruction Manual for "MagicBus™ i3000 Series Intelligent Steering," Teleflex, Inc.

* cited by examiner

REMOTE CONTROL DEVICE FOR A BOAT

CROSS-REFERENCE TO RELATED APPLICATIONS

This application is based on and claims priority under 35 U.S.C. § 119(a)-(d) to Japanese Patent Application No. 2006-183581, filed Jul. 3, 2006, the entire contents of which is hereby incorporated by reference.

BACKGROUND OF THE INVENTIONS

1. Field of the Inventions

The present inventions relate to the operation of a boat and, in particular, to a remote control device that houses a remote control engine control unit of the boat.

2. Description of the Related Art

Boats typically have a remote control device disposed on the hull of the boat for controlling the boat's propulsion units. A remote control engine control unit ("remote control ECU"), also disposed on the hull, communicates with an outboard motor motors.

In conventional systems, the remote control ECU and the main body of the remote control device are installed independently from one another at separate locations on the hull. Wires usually run from the remote control device to the remote control ECU to allow these two components to communicate with each other.

Installing the remote control ECU at a distance from the remote control device presents some disadvantages. For example, when spaced apart, the remote control device and the remote control ECU can take up a relatively significant amount of space on the boat's hull. In addition, it can be difficult to run wires between these two components because the wiring may interfere with other components of the boat or with a user's ability to operate the boat. Moreover, in such an arrangement, calibration and adjustment of the remote control ECU is often performed after the remote control ECU and the remote control device are installed at separate locations on the hull. In some situations, calibration can be complicated and troublesome for a typical boat operator.

SUMMARY OF THE INVENTIONS

In one embodiment, a remote control device for controlling a propulsion unit of a boat is provided. The remote control device comprises a main body having a shift lever for performing shift and throttle operations of a propulsion unit. The main body is disposed near a steering console of the boat. A housing board is coupled to the main body of the remote control device. The housing board extends from the main body in a generally downward direction. A remote control engine control unit is disposed substantially within the housing board. The remote control engine control unit is for providing an operation output signal to the propulsion unit based on an operation input signal received from the shift lever.

In another embodiment, a boat having a propulsion unit comprising a hull is provided. At least one outboard motor is connected to the hull. A seat is configured to accommodate at least one operator of the boat. A steering console is disposed near the seat. A remote control device is positioned near the steering console and is for controlling the at least one outboard motor. The remote control device comprises a main body having a shift lever. A housing board is fixed to the main body and extends therefrom in a generally downward direction. A remote control engine control unit is positioned substantially within the housing board. The remote control engine control unit is housed such that an operator can access the remote control engine control unit from either the starboard side or the port side of the boat.

BRIEF DESCRIPTION OF THE DRAWINGS

These and other features, aspects, and advantages of the present remote control device for a boat will now be described in connection with preferred embodiments of the inventions as shown in the accompanying drawings. The illustrated embodiments, however, are merely examples and are not intended to limit the remote control device to the specific embodiments described herein. The drawings include five figures.

DETAILED DESCRIPTION OF PREFERRED EMBODIMENTS

Embodiments of the present remote control device will be described hereinafter in detail with reference to the accompanying drawings. The structure of the remote control device will be described first. It should be noted that the remote control device described herein can be used with a variety of marine vehicles, such as, but not limited to, boats having a hull with more than one propulsion unit connected to the hull. In a preferred embodiment, the propulsion units include outboard motors. However, other types of propulsion units, such as stern drives, impellers, and the like are contemplated.

Figure 1:
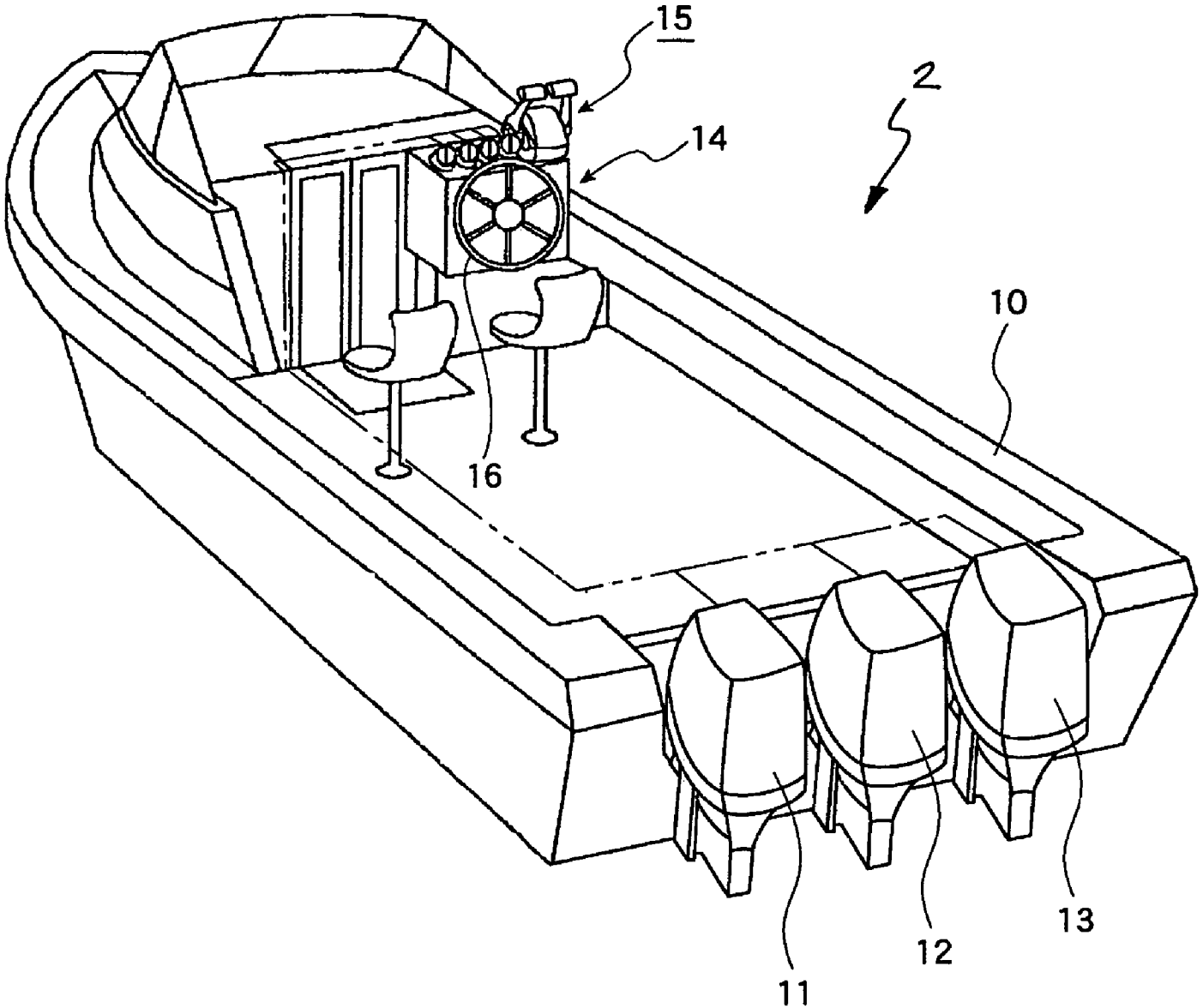
FIG. 1 is a rear perspective view of a boat having a plurality of outboard motors according to an embodiment of the present remote control device.

As shown in FIG. 1, in one embodiment of the present remote control device, a watercraft 2, such as a boat, is provided with three watercraft propulsion units. In this embodiment, the three watercraft propulsion units can comprise outboard motors disposed on the stem of a hull 10. The outboard motors comprise a port side outboard motor 11, a center outboard motor 12, and a starboard outboard motor 13. The boat 2 also includes, among other components, a remote control device 15 and a steering wheel device 16 arranged at or near a steering console 14 that is installed in the hull 10. The remote control device 15 and the steering wheel device 16 preferably operate each of the outboard motors 11, 12, 13.

Figure 2:
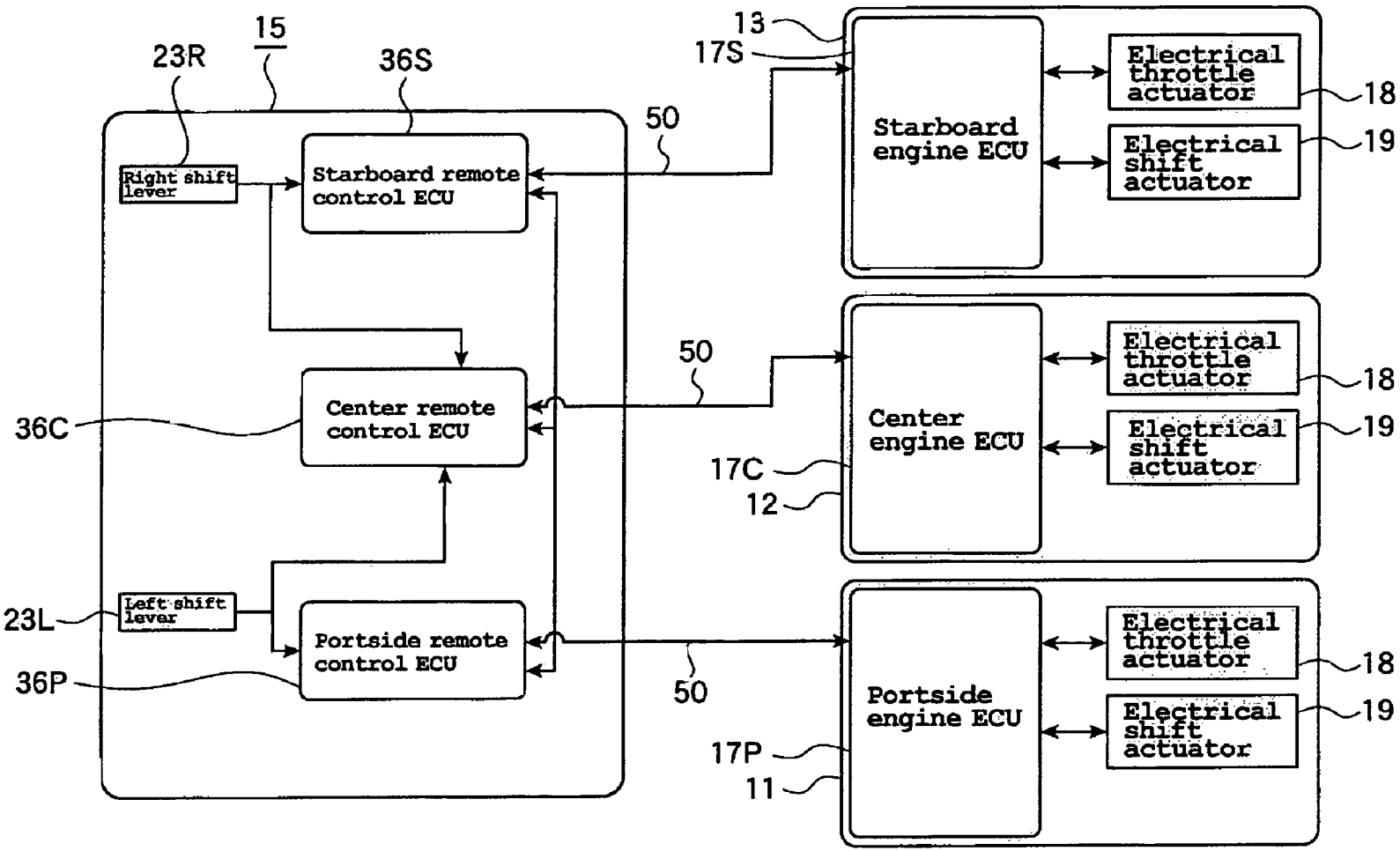
FIG. 2 is a block diagram of a remote control device, the plurality of outboard motors, and other components of the boat as shown in FIG. 1.

As illustrated in the function block diagram in FIG. 2, the remote control device 15 is networked with an electronic control system installed in each of the outboard motors 11, 12, 13. From the top right to the bottom right in FIG. 2, an engine control unit ("ECU") 17S of a starboard engine is installed in the starboard outboard motor 13, a center engine ECU 17C is installed in the center outboard motor 12, and a port side engine ECU 17P is installed in the port side outboard motor 11. Each ECU 17S, 17C, 17P has a central processing unit ("CPU") and controls a rotation of an engine (which is not shown in FIG. 2), a steering angle, and others characteristics of the boat based on various signals and data.

In one embodiment, each of the outboard motor engine control units 17S, 17C, 17P has various mechanisms to control the operation of an electrical throttle actuator 18 and a shift actuator 19. By controlling the electrical throttle actuator 18 and the shift actuator 19, the ECUs 17S, 17C, 17P can preferably control an operational state of an engine located in each of the outboard motors 13, 12, 11. It is contemplated that the ECUs 17S, 17C, 17P can control other components of the engines in order to further control the operation of the engines.

The remote control device 15 also comprises remote control engine control units 36S, 36C, 36P corresponding to the outboard motor engine control units 17S, 17C, 17P, respectively. In one embodiment, the remote control ECUs include a starboard remote control ECU 36S, a center remote control ECU 36C, and a port side remote control ECU 36P. The remote control ECUs 36S, 36C, 36P are installed in, or near, the remote control device 15, which is installed in the steering console 14 of the boat described herein. The remote control ECUs 36S, 36C, 36P are networked to the engine ECUs 17S, 17C, 17P, respectively, via a harness 50 that enables mutual communication between these components of the remote control device 15. In one embodiment, a controller area network ("CAN"), which is typically used to automatically control certain functions of an automobile, can be used as a communication protocol for the harness 50. In other embodiments, a dedicated protocol with high reliability and response can be used as a communication protocol.

The location and structure of an embodiment of the remote control device 15 will now be described primarily with reference to FIGS. 3 through 5. The remote control device 15 generally can be installed on a table in front of an operation panel on a front side of an operator's seat of the hull 10 or on a deck near the steering console 14 (as shown in FIG. 1).

Figure 3:
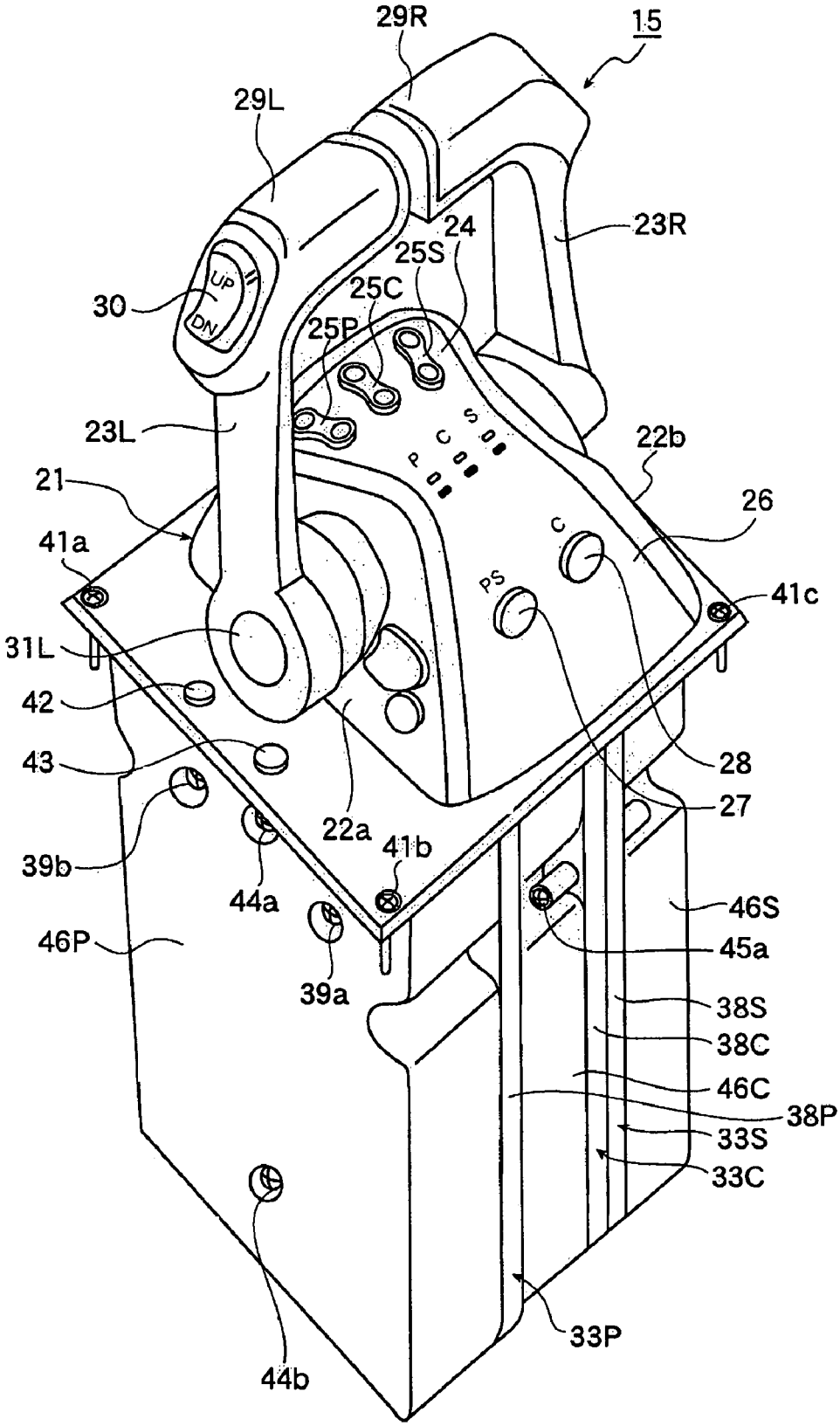
FIG. 3 is a perspective view of a remote control device according to an embodiment described herein.

With reference to FIG. 3, the illustrated remote control main body 21 is in the shape of the lower half of a pyramid and the corners and edge lines are rounded. A remote control main body 21 of the remote control device 15 preferably is assembled by combining injection-molded members made of synthetic resin materials. Other materials, however, may be used to construct the main body 21 of the remote control device 15. In addition, the main body 21 can define other suitable shapes such as rectangular, round, or ovoid configurations.

In one embodiment of the remote control device 15, a left shift lever 23L and a right shift lever 23R are freely rotatable in at least a forward direction and a rearward direction. The shift levers 23L, 23R preferably conduct a shift operation and a throttle operation of a propulsion unit of the plurality of outboard motors. In the illustrated embodiment, the shift levers 23L, 23R extend upright from the left side 22*a* and the right side 22*b* of the remote control main body 21.

In addition, an upper side 24 of the remote control main body 21 has tilt/trim angle adjustment switches 25P, 25C, 25S corresponding to each propulsion unit. The tilt/trim angle adjustment switches 25P, 25C, 25S are located in a position where an operator can operate them with his or her fingers when the operator places his or her hand on the main body 21 with the fingers facing the bow of the boat. To enhance convenience, a switch is not arranged in a part of the main body 21 in which a palm of the operator touches.

Control target changeover switches 27, 28 preferably are installed on the main body 21 of the remote control device 15. The control target changeover switches 27, 28 are designed to switch an engine as a target of a shift/throttle operation and are preferably arranged on a rear side 26 of the remote control main body 21. In one embodiment, a left/right control switch 27 is provided that controls the port side outboard motor 11 and the starboard outboard motor 13 and a center control switch 28 is provided that controls the center outboard motor 12.

In one embodiment, a left horizontal steering handle 29L and a right horizontal steering handle 29R are installed on top of the left shift lever 23L and the right shift lever 23R, respectively. A main tilt/trim angle adjustment switch 30 to adjust tilt/trim angles of the propulsion units is installed on top of the left shift lever 23L as shown in FIGS. 3 and 4.

Figure 4:
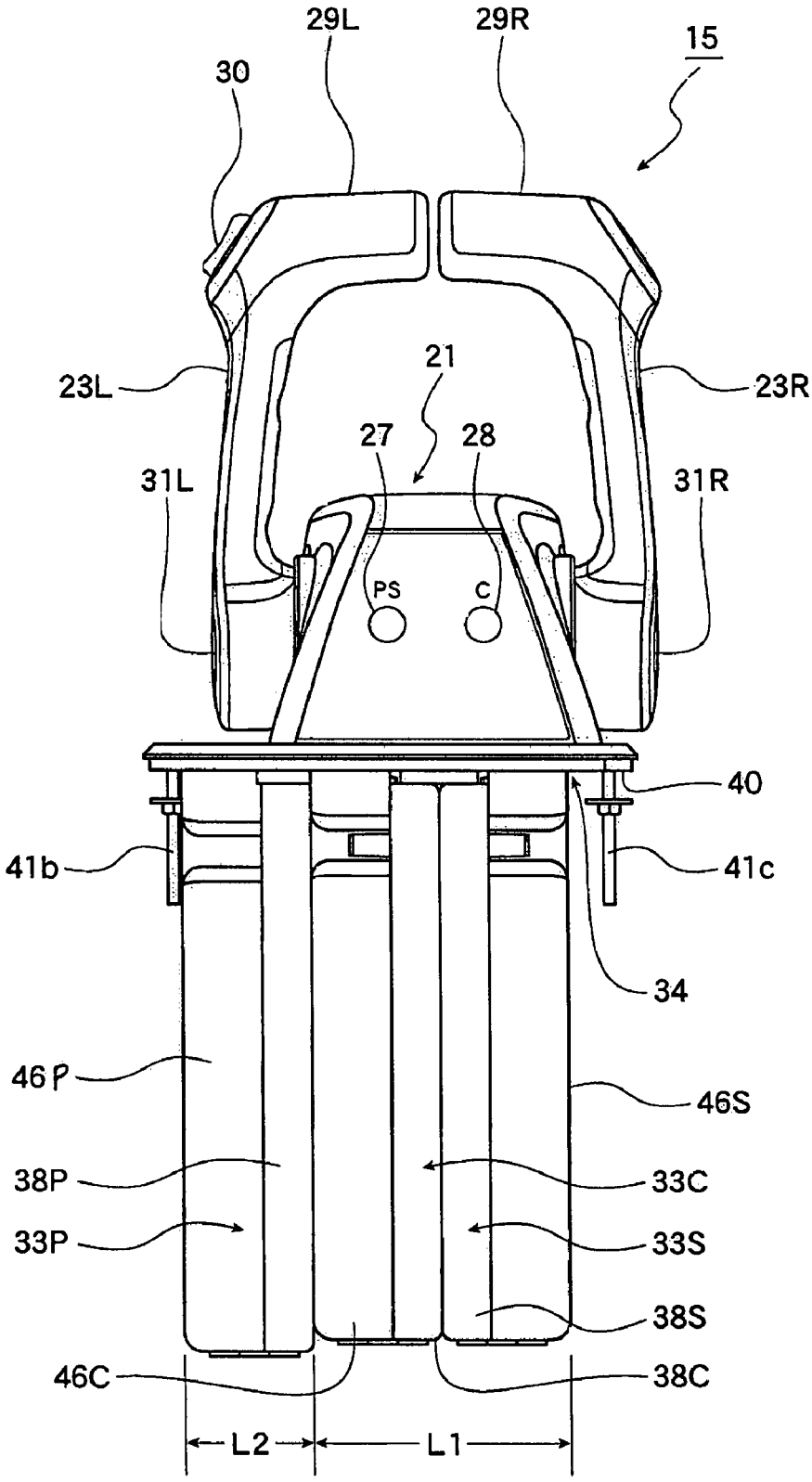
FIG. 4 is a front elevational view of the remote control device as shown in FIG. 3.

As best seen in FIG. 4, the left shift lever 23L is supported on a left side of the remote control main body 21 by a left shaft part 31L, and the right shift lever 23R is supported on a right side of the remote control main body 21 by a right shaft part 31R.

A mount panel 34, which is a generally horizontal surface, is formed under the remote control main body 21. As shown in FIG. 4, the mount panel 34 extends to approximately the same position as an outermost position of the right shift lever 23R on a right side of the remote control main body 21. The mount panel 34 preferably extends beyond an outermost position of the left shift lever 23L on a left side of the remote control device 15. In other words, in one embodiment, the left and right sides of the mount panel 34 make an asymmetrical shape if viewed from the top.

In one embodiment, a center housing board 33C and a right housing board 33S, generally in the shape of a rectangle and made of a non-conductive material such as resin, extend downward from the remote control main body 21. An additional board 33P is detachably attached to the center housing board 33C. In another embodiment, the housing parts 38S, 38C are detachably connected to the mount panel 34.

In an embodiment of the remote control device 15, the center housing board 33C and the right housing board 33S are formed symmetrically, with each board extending vertically. A surface of the right housing board 33S on one side (a left side in FIG. 4; the same applies throughout the specification) and a surface of the center housing board 33C on the other side (a right side in FIG. 4; the same applies throughout the specification) are in contact, and the housing boards 33C, 33S are arranged symmetrically with respect to the center of the remote control main body 21. As shown in FIGS. 3 and 5, the center housing board 33C and the right housing part 33S are installed vertically across the mount panel 34, and are fixed with a screw 45*a* (other suitable fastening devices are also contemplated). In other words, in one embodiment, the right housing part 38S and the center housing part 38C are fixed to the remote control main body 21 in a manner such that they cannot be detached.

Although not shown in the figures, a part of the center housing board 33C disposed higher than the mount panel 34 supports the left shaft part 31L in the remote control main body 21. In a similar manner, a part of the right housing board 33S positioned higher than the mount panel 34 supports the right shaft part 31R in the remote control main body 21.

For the part of the center housing board 33C generally in the shape of a rectangle and protruding under the mount panel 34, a board material extends from a peripheral part in a perpendicular direction (a left side in FIG. 4), and a part surrounded with the extended board materials forms the center housing part 38C opening to the one side with a generally recessed cross-section. For the part of the right housing board 33S generally in the shape of a rectangle and protruding under the mount panel 34, a board material extends from a peripheral part in a perpendicular direction (a right side in FIG. 4), and a part surrounded with the extended board materials forms the right housing part 38S opening to the other side with a generally recessed cross-section.

In one embodiment, the center housing part 38C and the right housing part 38S are formed symmetrically if viewed from a side as shown in FIG. 4. The center housing part 38C is positioned on one side of the center housing board 33C, while the right housing part 38S is positioned on the other side of the right housing board 33S. The center housing board 33C and the right housing board 33S are preferably in contact with each other. As a result of this arrangement, objects to be housed (for example, the center remote control ECU 36C and the starboard remote control ECU 36S, as mentioned below) can be housed in opposing housing structures with the center housing board 33C and the right housing board 33S disposed between them. Suitable housing spaces for such objects are advantageously provided.

In addition, in one embodiment, because two remote control ECUs (for example, the starboard remote control ECU 36S and the center remote control ECU 36C) are housed in the starboard housing part 38S and the center housing part 38C, which are fixed to the remote control main body 21 in a manner such that they cannot be detached, a remote control device 15 that can be used for many purposes in a watercraft provided with a plurality of outboard motors can be formed based on a remote control device for a watercraft provided with two outboard motors.

Although not illustrated in the drawings, the center remote control ECU 36C is arranged inside the center housing part 38C. The center remote control ECU 36C is generally in the shape of a board, with one surface facing one side of the remote control device 15 and another surface facing the other side.

A center connector unit (which is not shown) is installed in the center remote control ECU 36C. The center connector unit has a conductive terminal, a lead wire, and other components. The center connector unit connects lead wires from various electrical equipment inside the remote control main body 21, such as a Hall IC (which is also not shown) and an I/O (Input/Output) port on the center remote control ECU 36C. In other words, various electrical equipment inside the remote control main body 21, and the center remote control ECU 36C arranged on the mount panel 34, are connected at the center connector unit in a state where a signal can be transmitted to a propulsion unit.

As shown in FIG. 4, in one embodiment, the width L1 of the center housing part 38C and a center ECU case 46C together with the right housing part 38S and a right ECU case 46S is generally about the same as the width of the remote control main body 21. These components can be installed in a position generally directly below the remote control main body 21 under the mount panel 34. In other words, the position generally directly below the remote control main body 21 is predetermined by the mount panel 34 as a position where the center housing part 38C and the center ECU case 46C together with the right housing part 38S and the right ECU case 46S are to be installed. In this way, in one embodiment of the present remote control device 15, the structure of the mount panel 34 can determine how the center housing part 38C and the right housing part 38S are to be installed in the remote control main body 21. As a result, the center remote control ECU 36C and the starboard remote control ECU 36S can be advantageously installed in the remote control main body 21 with increased convenience and an installation space of the remote control device 15 can be made compact.

The center ECU case 46C is arranged on one side of the center remote control ECU 36C. The center ECU case 46C is formed to have a generally recessed cross section by extending peripheral parts on the four sides of a board material generally in the shape of a rectangle and made of a non-conductive material such as resin in a perpendicular direction, and a part surrounded with the extended peripheral parts makes an opening. The opening of the center ECU case 46C is open to the other side and linked to the opening of the center housing part 38C. The center remote control ECU 36C and the center connector unit (which is not shown) are housed inside the center housing part 38C and the center ECU case 46C. The center housing part 38C and the center ECU case 46C are fixed by a plurality of screws, such as the screw 51 shown in FIG. 5.

Figure 5:
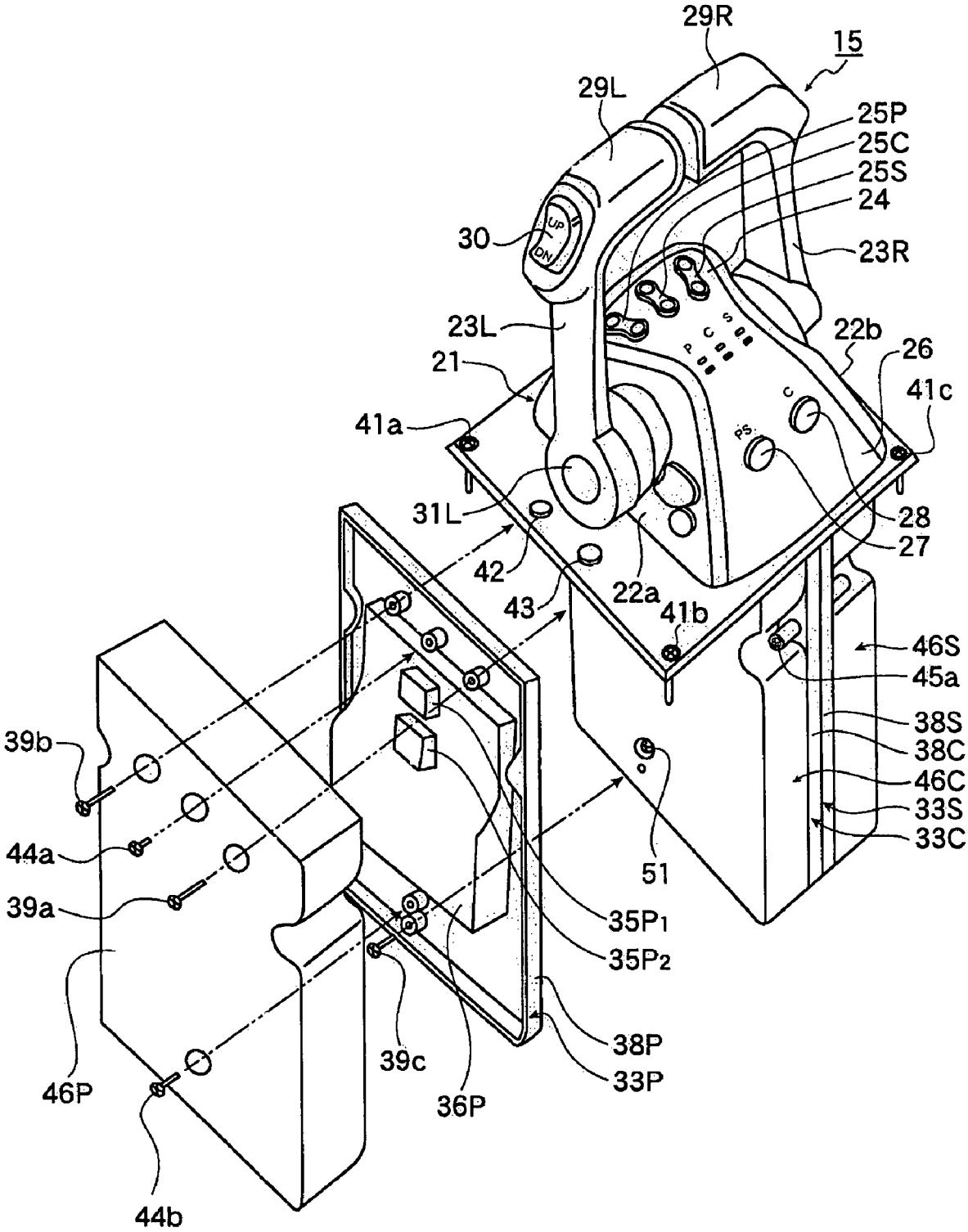
FIG. 5 is an exploded perspective view of the remote control device as shown in FIG. 3 with a port side remote control engine control unit and a left housing part shown in an exploded configuration.

As shown in FIGS. 4 and 5, the right ECU case 46S is arranged on the other side of the right housing part 38S. The right ECU case 46S preferably is symmetrical with the center ECU case 46C and can be made of the same material as the center ECU case 46C. The right ECU case 46S is formed to have a generally recessed cross-section. The starboard remote control ECU 36S (which is not shown in FIG. 4) having a similar structure as the center remote control ECU 36C and a right connector unit (which is also not shown) having a similar structure and function as the center connector unit (not shown) are housed inside the right housing part 38S and the right ECU case 46S.

With reference now to FIG. 5, in one embodiment, an additional board 33P is installed on one side of the center ECU case 46C, and the additional board 33P forms a left housing part 38P. The left housing part 38P is formed to have a generally recessed cross-section by extending peripheral parts on the four sides of a board material generally in the shape of a rectangle and made of a non-conductive material such as resin in a perpendicular direction (a left direction in FIG. 4). A part of the left housing part 38P surrounded with the extended peripheral parts has a generally recessed cross-section and is open to the one side. The other side of the left housing part 38P is in contact with the one side of the center ECU case 46C.

As shown in FIG. 5, the additional board 33P preferably is arranged in a lower part of the mount panel 34. The additional board 33P can be attached to and detached from the remote control main body 21. Therefore, an object housed inside the left housing part 38P (such as the port side remote control ECU 36P, as mentioned below) can be installed or removed by attaching and detaching the additional board 33P. As such, the remote control device 15 can be advantageously used for a watercraft having two outboard motors and also for a watercraft having three outboard motors. In addition, since the additional board 33P can be freely attached to and detached from the remote control main body 21, the port side remote control ECU 36P, which is an object housed in the left housing part 38P, can be easily attached to and detached from the remote control main body 21.

The port side remote control ECU 36P, having generally a similar structure to the starboard remote control ECU 36S and the center remote control ECU 36C, is housed in the left housing part 38P. Specifically, the board surfaces of the port side remote control ECU 36P and the center remote control ECU 36C are opposed to each other.

In one embodiment, two left connector units 35P1 and 35P2 having the same structure as the center connector unit (which, as previously mentioned, is not shown) are installed in the port side remote control ECU 36P. The left connector units 35P1, 35P2 connect electrical equipment inside the remote control main body 21 and the port side remote control ECU 36P in a state where a signal can be transmitted to the port side outboard motor 11.

As shown in FIG. 4, the left housing part 38P and the left ECU case 46P are installed as protruding from a position generally directly below the remote control main body 21 in a lower part of the mount panel 34 toward one side of the remote control main body 21 (which, as shown, is a left side or a side facing the port side of the boat). In other words, a position protruding toward the one side from the position generally right below the remote control main body 21 is predetermined as a position where the left housing part 38P and the left ECU case 46P are to be installed. In this way, the structure of the mount panel 34 can determine how the left housing part 38P is to be installed on the remote control main body 21. As a result, the port side remote control ECU 36P can be advantageously installed on the remote control main body 21 with increased convenience and an installation space of the remote control device 15 can be made compact.

In addition, since the left housing part 38P with the additional board 33P is installed below a part of the mount panel 34 extended to the one side of the remote control main body 21, a remote control device 15 corresponding to an application where the number of remote control engine control units is increased to three can also be advantageously formed based on the remote control main body 21 using two remote control engine control units.

The left ECU case 46P can be arranged on a top side (a left side in FIG. 4) of the port side remote control ECU 36P. The left ECU case 46P preferably is formed to have a similar cross-section generally in a U-shape using a similar non-conductive material as used in the right ECU case 46S and the center ECU case 46C. Peripheral edges on the four sides of the left housing part 38P and peripheral edges on the four sides of the left ECU case 46P are linked, and the port side remote control ECU 36P and the left connector units 35P1 and 35P2 are housed inside the left housing part 38P and the left ECU case 46P.

As illustrated in FIG. 5, the left housing part 38P and the left ECU case 46P can be coupled by using two screws 44*a*, 44*b*. In one embodiment, a first screw 44*a* is disposed on an upper portion of the left ECU case 46P and a second screw 44*b* is disposed on a lower portion of the left ECU case 46P. The left housing part 38P and the center housing part 38C can be fixed together by three screws 39*a*, 39*b*, 39*c*.

Because each of the remote control ECUs 36P, 36C, 36S is formed generally in the shape of a board and housed in each of the respective housing parts 38P, 38C, 38S with their board surfaces side opposed to each other, the board surface of each of the remote control ECUs 36P, 36C, 36S faces generally the same direction. Advantageously, the remote control ECUs 36P, 36C, 36S are installed to the hull 10 with their board surfaces arranged in a perpendicular direction so that an installation space of each of the remote control ECUs 36P, 36C, 36S can be made compact.

As seen in FIG. 4, peripheral parts on the four sides of the mount panel 34 are formed on a hull mount part 40. A bottom surface of the hull mount part 40 is formed in such a shape that it is stably installed to a top surface of the hull 10, which is typically a generally flat surface. The four corners of the hull mount part 40 can have three screws 41*a*, 41*b*, 41*c* (each is shown in FIG. 5) and another screw (which is not shown in the figures) to to fix the hull mount part 40 to the hull 10.

Because the hull mount part 40 is formed in a peripheral part of the mount panel 34, the remote control device 15 and the hull 10 are connected to each of the remote control ECUs 36P, 36C, 36S so that it is not necessary to secure a large space to couple the remote control device 15 to the hull 10.

With reference to FIG. 3, when a port side remote control ECU 36P is to be used in the remote control device 15, control target changeover switches 42, 43 similar to those at the rear side 26 of the remote control main body 21 (which are a left/right control switch 42 corresponding to a case where the port side outboard motor 11 and the starboard outboard motor 13 are controlled and a center control switch 43 to control the center outboard motor 12) can be installed on a top surface of the mount panel 34 above the port side remote control ECU 36P, which is a part of the mount panel 34 extended to the one side.

Because the left/right control switch 42 and the center control switch 43 are installed on a top surface of the mount panel 34 extended to the one side, switching an engine used for navigation can be easily conducted by an operator's hand if the extended side is installed on a side of the operator facing a port side of the boat.

As described above, an embodiment of the present remote control device 15 can integrate the remote control main body 21 (where the left shift lever 23L and the right shift lever 23R are installed), the port side remote control ECU 36P, the center remote control ECU 36C, and the starboard remote control ECU 36S. As a result, it is not necessary to form a space to arrange each of the remote control ECUs 36P, 36C, 36S separately from a space for the remote control main body 21 on the hull 10 of a watercraft. In addition, because each of the remote control ECUs 36P, 36C, 36S can be adjusted and/or calibrated corresponding to the remote control main body 21 during manufacture of the remote control device 15, no calibration is necessary after each of the remote control ECUs 36P, 36C, 36S is installed to the hull 10. Thus, an operator of a boat having the present remote control device 15 can operate the boat in an easier manner.

In one embodiment, the remote control device 15 is applied to a boat provided with three outboard motors, which are the port side outboard motor 11, the center outboard motor 12, and the starboard outboard motor 13. The present remote control device 15 described herein is not limited thereto, however, and the remote control device 15 may be applied to a boat having one, two, four, or more outboard motors installed on its hull. In this case, the number of remote control ECUs connected to the mount panel 34 of the remote control main body 21, and a procedure to set and install the remote control device 15, preferably varies according to the number of outboard motors installed on the hull.

For example, in an application where a boat has two outboard motors comprising a port side outboard motor 11 and a starboard outboard motor 13, the remote control device 15 can be installed on a hull with only the starboard remote control ECU 36S and the center remote control ECU 36C connected to the mount panel 34. In such an embodiment, the starboard remote control ECU 36S and the center remote control ECU 36C are adjusted to control an operation of the starboard outboard motor 13 and to control an operation of the port side outboard motor 11, respectively. In addition, an opening formed in a front panel of the hull 10 can be made to have the width L1 (as shown in FIG. 5) of the center housing part 38C and the center ECU case 46C together with the right housing part 38S and the right ECU case 46S.

In the embodiment described in the preceding paragraph, the center housing part 38C and the right housing part 38S are formed on the one side of the center housing board 33C and on the other side of the right housing board 33S, respectively. Surfaces of the center housing part 38C and the right housing part 38S preferably are in contact with each other. The cost to manufacture and assemble the remote control device 15 can be reduced by decreasing the number of components used therein, such as by forming a center housing part and a right housing part on one side and on the other side, respectively, of one housing board.

Although this remote control device has been disclosed in the context of certain preferred embodiments and examples, it will be understood by those skilled in the art that the present remote control device extends beyond the specifically disclosed embodiments to other alternative embodiments and/or uses of the remote control device and obvious modifications and equivalents thereof. In addition, while a number of variations of the remote control device have been shown and described in detail, other modifications, which are within the scope of this remote control device, will be readily apparent to those of skill in the art based upon this disclosure. It is also contemplated that various combinations or sub-combinations of the specific features and aspects of the embodiments may be made and still fall within the scope of the remote control device. Accordingly, it should be understood that various features and aspects of the disclosed embodiments can be combined with or substituted for one another in order to form varying modes of the disclosed remote control device. Thus, it is intended that the scope of the present remote control device herein disclosed should not be limited by the particular disclosed embodiments described above, but should be determined only by a fair reading of the claims.

What is claimed is:

1. A remote control device for controlling a propulsion unit of a boat, the remote control device comprising a main body having a rotatable shift lever for performing shift and throttle operations of a propulsion unit, the main body disposed near a steering console of the boat, the rotatable shift lever comprising an elongated arm pivotally connected to the main body of the remote control device at a first end of the elongated arm and a hand grip that extends from a second end of the elongated arm, a housing board coupled to the main body of the remote control device, the housing board extending from the main body in a generally downward direction, and a remote control engine control unit disposed substantially within the housing board, the remote control engine control unit being configured to generate an operation output signal to the propulsion unit based on an operation input signal received from the shift lever, wherein the housing board comprises a first housing board, a second housing board, and a third housing board, the first housing board configured to house a first remote control engine control unit and the second housing board configured to house a second remote control engine control unit, wherein at least a portion of the first housing board and at least a portion of the second housing board are substantially fixed with respect to the main body of the remote control device and wherein the third housing board is configured to attach to and detach from one of the first housing board and the second housing board.

2. The remote control device of claim 1, wherein an operator can access the remote control engine control unit from one of a starboard side and a port side of the boat.

3. The remote control device of claim 1, wherein the housing board comprises a housing part and an engine control unit case, the housing part defining a recess for housing at least one of the first remote control engine control unit and the second remote control engine control unit, the engine control unit case capable of being attached to and detached from the housing part.

4. The remote control device of claim 3, wherein the housing part comprises a connector unit being configured to facilitate an electrical connection between at least one of the first remote control engine control unit and the second remote control engine control unit and an electrical component of the main body.

5. The remote control device of claim 1, wherein the first housing board houses a starboard side remote control engine control unit, the second housing board houses a center remote control engine control unit, and the third housing board houses a port side remote control engine control unit.

6. The remote control device of claim 1 further comprising a mount panel disposed on a lower portion of the remote control main body, wherein the housing board is coupled to the mount panel.

7. The remote control device of claim 6, wherein the mount panel comprises a hull mount part for mounting the remote control device on a panel of the steering console.

8. The remote control device of claim 6, wherein the mount panel comprises an extended portion that extends from the main body toward one of a starboard side and a port side of the boat.

9. The remote control device of claim 8, wherein the remote control main body lower portion is arranged generally offset from a center of the mount panel.

10. The remote control device of claim 8, where in the third housing board is disposed generally below the extended portion of the mount panel.

11. The remote control device of claim 8 further comprising a control target changeover switch for controlling the operation of a propulsion unit, wherein the control target changeover switch is disposed on an tipper side of the extended portion.

12. The remote control device of claim 8, wherein the first and second housing boards are arranged on the mount panel to be generally centered below the remote control main body lower portion, and a space sized and adapted to accommodate the third housing board is provided under the mount panel and to the side of one of the first and second housing boards.

13. A boat having a propulsion unit comprising a hull, at least one outboard motor connected to the hull, a seat configured to accommodate at least one operator of the boat, a steering console disposed near the seat, and a remote control device positioned near the steering console and for controlling the at least one outboard motor, the remote control device comprising a main body having a rotatable shift lever, the shift lever comprising an elongated shaft pivotally connected to the remote control main body at one end of the shift lever and a handle disposed at another end of the shift lever, a housing board fixed to the main body and extending therefrom in a generally downward direction, and a remote control engine control unit positioned substantially within the housing board, the remote control engine control unit disposed such that an operator can access the remote control engine control unit from one of a starboard side and a port side of the boat, wherein the remote control device further comprises an additional housing board, the additional housing board capable of being attached to and detached from the housing board that is fixed to the main body of the remote control device, and wherein the remote control device further comprises a mount panel disposed on a lower portion of the main body and having an extended portion such that the housing board that is fixed to the main body is disposed generally below the main body of the remote control device and the additional housing board is disposed generally below the extended portion of the mount panel.

14. The boat of claim 13, wherein the additional housing board is disposed on a side of the remote control device generally facing the port side of the boat.

15. The remote control device of claim 1, wherein the rotatable shift lever is movable through a range of throw motion and the housing board is arranged not to extend beyond the throw range of the shift lever.

16. The remote control device of claim 1, wherein the main body of the remote control device supports the housing board.

17. The remote control device of claim 1, wherein the housing board defines a length that extends downward in a generally vertical direction from the main body of the remote control device and a width that extends in a generally horizontal direction from a port side to a starboard side of the remote control device such that the length of the housing board is greater than the width of the housing board.

18. The remote control device of claim 3, wherein an operator can access the housing board and the remote control engine control unit without removing the housing board from the main body of the remote control device.

19. A remote control device for controlling a propulsion unit of a boat, the remote control device comprising a main body having a rotatable shift lever for performing shift and throttle operations of a propulsion unit, the main body disposed near a steering console of the boat, the rotatable shift lever comprising an elongated arm pivotally connected to the main body of the remote control device at a first end of the elongated arm and a hand grip that extends from a second end of the elongated arm, a housing board coupled to the main body of the remote control device, the housing board extending from the main body in a generally downward direction, a remote control engine control unit disposed substantially within the housing board, the remote control engine control unit being configured to generate an operation output signal to the propulsion unit based on an operation input signal received from the shift lever, a mount panel disposed on a lower portion of the remote control main body, wherein the housing board is coupled to the mount panel and the mount panel comprises an extended portion that extends from the main body toward one of a starboard side and a port side of the boat, and a control target changeover switch for controlling the operation of a propulsion unit, wherein the control target changeover switch is disposed on an upper side of the extended portion.

20. The remote control device of claim 19, wherein the mount panel comprises a hull mount part for mounting the remote control device on a panel of the steering console.

21. The remote control device of claim 19, wherein the remote control main body lower portion is arranged generally offset from a center of the mount panel.

22. The remote control device of claim 19, wherein the housing board comprises a first housing board, a second housing board, and a third housing board, the third housing board configured to attach to and detach from one of the first housing board and the second housing board, wherein the third housing board is disposed generally below the extended portion of the mount panel.

23. A remote control device for controlling a propulsion unit of a boat, the remote control device comprising a main body having a rotatable shift lever for performing shift and throttle operations of a propulsion unit, the main body disposed near a steering console of the boat, the rotatable shift lever comprising an elongated arm pivotally connected to the main body of the remote control device at a first end of the elongated arm and a hand grip that extends from a second end of the elongated arm, a housing board coupled to the main body of the remote control device, the housing board extending from the main body in a generally downward direction, a remote control engine control unit disposed substantially within the housing board, the remote control engine control unit being configured to generate an operation output signal to the propulsion unit based on an operation input signal received from the shift lever, and a mount panel disposed on a lower portion of the remote control main body, wherein the housing board is coupled to the mount panel and the mount panel comprises an extended portion that extends from the main body toward one of a starboard side and a port side of the boat, wherein the housing board comprises a first housing board and a second housing board, the first and second housing boards being arranged on the mount panel to be generally centered below the remote control main body lower portion, and a space sized and adapted to accommodate a third housing board is provided under the mount panel and to the side of one of the first and second housing boards.

24. The remote control device of claim 23, wherein the mount panel comprises a hull mount part for mounting the remote control device on a panel of the steering console.

25. The remote control device of claim 23, wherein the remote control main body lower portion is arranged generally offset from a center of the mount panel.

* * * * *

UNITED STATES PATENT AND TRADEMARK OFFICE

CERTIFICATE OF CORRECTION

PATENT NO. : 7,507,130 B2
APPLICATION NO. : 11/731086
DATED : March 24, 2009
INVENTOR(S) : Watanabe et al.

It is certified that error appears in the above-identified patent and that said Letters Patent is hereby corrected as shown below:

At column 1, line 22, after "motor" please insert --engine control unit ("outboard motor ECU") to control operation of the boat's outboard--.

At column 2, line 48, please delete "stem" and insert --stern-- in place thereof.

At column 7, line 60, immediately before "fix" please delete "to".

At column 10, line 24 (approximately), in Claim 10, please delete "where in" and insert --wherein-- in place thereof.

At column 10, line 30 (approximately), in Claim 11, please delete "tipper" and insert --upper-- in place thereof.

Signed and Sealed this

Tenth Day of November, 2009

David J. Kappos

David J. Kappos
*Director of the United States Patent and Trademark Office*